United States Patent [19]

Garner

[11] 4,358,019

[45] Nov. 9, 1982

[54] BOOK END

[76] Inventor: Linton S. Garner, 1902-1450 W. Georgia St., Vancouver, B.C., V6G 2T8, Canada

[21] Appl. No.: 147,128

[22] Filed: May 6, 1980

[51] Int. Cl.[3] ..... A47B 63/00

[52] U.S. Cl. ..... 211/42; 248/345.1

[58] Field of Search ..... 211/42; 248/459, 345.1; 40/158 A, 152.1; 206/424, 586; 229/DIG. 1

[56] References Cited

U.S. PATENT DOCUMENTS

| | | | |
|---|---|---|---|
| 1,795,526 | 3/1931 | Turner | 211/42 |
| 3,151,832 | 10/1964 | Doll | 248/345.1 |
| 3,220,683 | 11/1965 | Doll | 248/345.1 |
| 3,511,464 | 5/1970 | Doll | 248/345.1 |
| 3,592,344 | 7/1971 | Schade | 211/42 |
| 3,900,156 | 8/1975 | Clark | 248/345.1 X |
| 4,192,423 | 3/1980 | Rekow | 248/345.1 X |

FOREIGN PATENT DOCUMENTS

| | | | |
|---|---|---|---|
| 855059 | 11/1970 | Canada | 248/345.1 |
| 570704 | 7/1945 | United Kingdom | 211/42 |

*Primary Examiner*—Ernest R. Purser

*Attorney, Agent, or Firm*—Sixbey, Friedman & Leedom

[57] ABSTRACT

A one piece folding blank foldable to form a book end having side walls and a base of triangular form, the planes and side walls and base being normal to each other. The blank comprises three rigid planes of similar right triangular shape. Two panels are joined to a central panel at fold lines consisting of flexible webs along non-hypotenuse sides. Cooperating and interlocking means are provided on the non-hypotenuse sides of the outer panels, the interlocking means releasably mating in the plane of one of the outer panels to secure the panels in position and form the book end when the panels are folded to positions normal to each other. When so folded, a pair of these blanks form a pair of book ends with base and side walls. The side walls are adapted to rest against the side and front or back portions of a series of books to stabilize them in upright position. Such book ends provide a neat and attractive means to display books in a multitude of different manners.

5 Claims, 4 Drawing Figures

30

4
8
6

40
6
4

12
22
8
24
14
20
16
18
4
6
30
2
10

BOOK END

BACKGROUND OF THE INVENTION

The present invention relates to book ends, and more particularly to flat blanks which may be readily folded to form book ends.

Known types of book ends include objects having a relatively low center of gravity and a flat base, and a flat side against which the end book in a series of books is supported. Such book ends must be of relatively heavy weight to hold books in an upright position.

Another type of book end consists of a vertical, flat upright portion and a flat tongue extending inwardly, parallel to a flat base the books rest upon the tongue when in position. Since the weight of the books on the tongue stabilizes the upright portion of the book end, against which the end book of a series of books rests when supported, the weight requirements of such a book end are greatly diminished. Such book ends are often stamped out of flat metal. Since the tongue must be a rigid extension perpendicular to the vertical side of the book end, such a book end tends to be bulky.

Therefore, the present invention relates to a flat blank which is inexpensive to manufacture, lightweight, and easy to fold into an assembled book end, which is appropriately shaped to retain books in vertical position on a flat, horizontal surface.

SUMMARY OF THE INVENTION

The present invention is directed to a one piece folding blank adapted to be folded to form a book end having side walls and a base of triangular form, the planes of the side walls and base being normal to each other. The blank comprises three rigid panels of similar, right triangular shape. One of the panels is joined, at a fold line consisting of a flexible web along one of its non-hypotenuse sides, to one of the non-hypotenuse sides of a second panel so that their right triangle are adjacent. The third panel similarly is joined, at a fold line consisting of a flexible web along one of its non-hypotenuse sides to the other of the non-hypotenuse sides of the second panel so that their right triangles are similarly adjacent. Cooperating, interlocking means are provided on the other, non-hypotenuse sides of the first and third panels. The interlocking means releasably mate in the plane of the first or third panel to secure the panels in position and form a book end when the panels are folded to positions normal to each other.

When so folded, the blank forms a triangular book end, having a horizontal triangular base upon which portions of books supported by the book end rest, and two vertical sides lying in planes perpendicular to each other, which support the sides, and support and align the front or backs, of books contained therein. As in the case of the tongue type book ends, the weight of the books resting on the base panel secures the book end in position supporting the books. Consequently the book end can be of light weight. Its shape permits it to fit snugly against books and requires little clearance from other objects adjacent to books being supported.

BRIEF DESCRIPTION OF THE DRAWINGS

These and other objects and advantages of the invention will become apparent upon reading the following detailed description and upon referring to the accompanying drawings in which.

In the drawings, similar features have been given similar reference numerals.

Figures 1, 2, 3, 4:
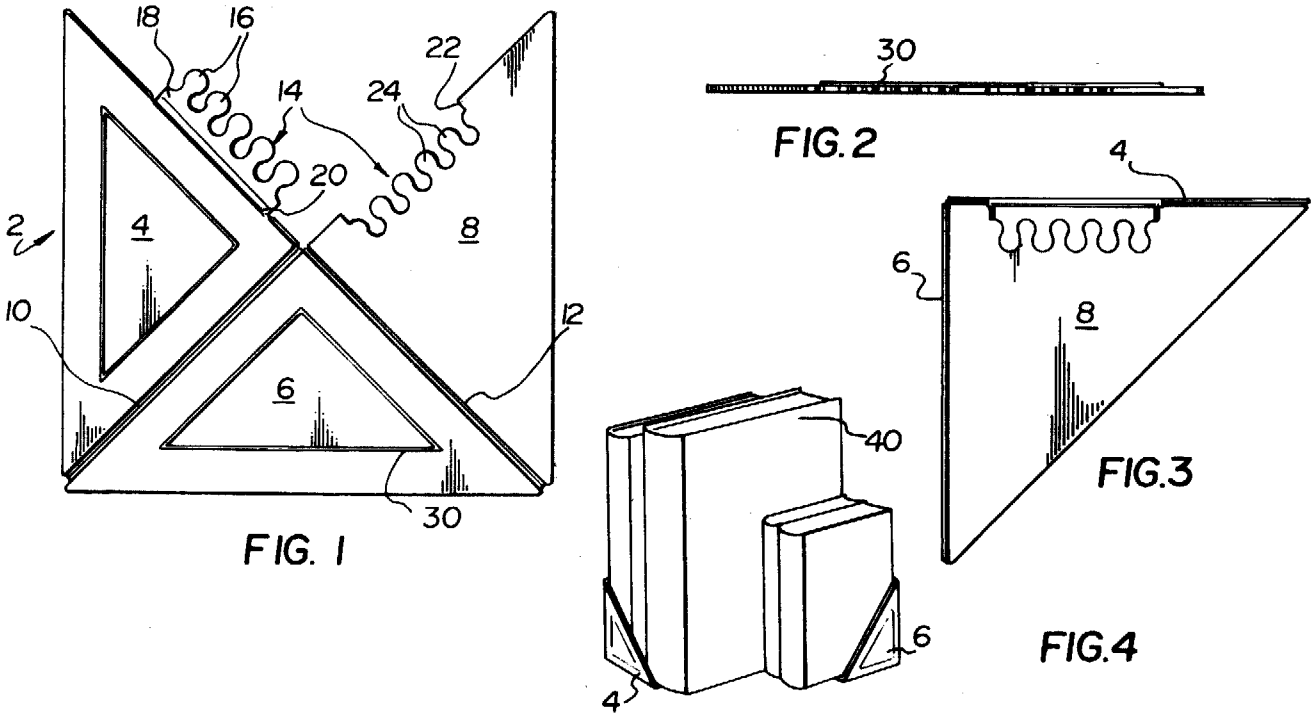
FIG. 1 illustrates a plan view of the blank of the book end according to the present invention.
FIG. 2 is a side view of the blank of FIG. 1.
FIG. 3 is a bottom view of the blank according to the present invention, folded into a book end, as viewed from the base.
FIG. 4 is a perspective view of a pair of book ends according to the present invention in position retaining in an upright position a series of books.

While the invention will be described in connection with a preferred embodiment thereof, it will be understood that it is not intended to limit the invention to such embodiment. On the contrary, it is intended to cover all alternatives, modifications and equipments as may be included within the spirit and scope of the invention as defined by the appended claims.

DETAILED DESCRIPTION OF THE INVENTION

Turning to FIG. 1, there is shown a one piece folding blank 2, comprising rigid panels 4, 6 and 8 of right triangular shape. The panels are joined as illustrated at fold lines consisting of flexible webs 10 and 12 extending along the length of adjacent, non-hypotenuse sides of panels 4 and 6 and panels 6 and 8. Cooperating, interlocking means 14 are provided on the other, non-hypotenuse sides of panels 4 and 8, the interlocking means comprising a plurality of mating, flat spaced knobs 16 extending from tab 18, and secured by means of flexible web 20 to the side of panel 4. Tab receiving cut 22 and the plurality of spaced knobs 16 interlock in the spaces between knobs 24, and knobs 24 interlock in the spaces between knobs 16 (as shown in FIG. 3). It will be noted that, in interlocked position, as shown in FIG. 3, knobs 16 and tab 18 lie in the same plane as panel 8 and knobs 24.

As can be seen in FIGS. 1 and 4, appropriate ornamentation 30 may be formed on the exposed surfaces of panels 4 and 6.

As can be seen from FIGS. 3 and 4, to form a book end from blank 2, panels 4 and 8 are folded along webs 10 and 12 to position perpendicular to the plane of panel 6. In that position panels 4 and 8 will also be lying in planes perpendicular to each other. Tab 18 and knobs 16 are then folded about web 20 to interlock with tabs 24 in the plane of panel 8. In this manner a rigid book end having side walls and base of right triangular form is formed.

As can be seen from FIG. 4, the weight of books resting on base panel 8, when the book ends are in position, stabilizes the book end so that the books are held in position by vertical panels 4 and 6. The manner in which the book ends support books in vertical position permits their use in very limited space. The book ends themselves are extremely lightweight, and may be made from any appropriate plastic material. The book ends according to the present invention also permit books of irregular sizes to be readily held, in appropriate alignment, as shown in FIG. 4. The lightweight, planar nature of the blank from which the book ends are created significantly assists in the handling and storage of book ends, making them commercially desirable items for mail order sales or stacking in stores having little inventory storing space.

Thus it is apparent that there has been provided in accordance with the present invention a one piece folding blank for forming a book end, which fully satisfies the objects, aims and advantages set forth above. While the invention has been described in conjunction with a preferred embodiment thereof, it is evident that many alternatives, modifications and variations will be apparent to those skilled in the art in light of the foregoing description. Accordingly it is intended to embrace all such alternatives, modifications and variations as fall within the spirit and broad scope of the appended claims.

The embodiments of the invention in which an exclusive property or privilege is claimed are defined as follows:

1. A one piece blank before folding having, a first side, a second side equal in length to said first side and extending normal thereto from an end thereof, a third side equal in length to said first and second sides and extending from the remaining end of said first side in parallel relationship to said second side, a fourth side extending from the remaining end of said second side toward the juncture of said first and third sides at an angle of 45°, and a fifth side extending from the remaining end of said third side toward the juncture of said first and second sides at an angle of 45°, said fourth and fifth sides terminating at a juncture therebetween and forming a 90° angle at said juncture.

2. The blank of claim 1 having a first fold line extending from the juncture of said first and second sides to the juncture of said fourth and fifth sides and having a second fold line extending from the juncture of said second and said third sides to the juncture of said fourth and fifth sides.

3. The blank of claim 1 wherein said fourth side includes a plurality of spaced flat tabs and said fifth side includes a plurality of spaced tab receiving cuts which correspond to said plurality of spaced flat tabs of said fourth side.

4. A one piece folding blank adapted to form a book end comprising:

a. first right triangular panel, said first right triangular panel having a first non-hypotenuse side, a second non-hypotanuse side, and a hypotenuse side;

b. a second right triangular panel, said second right triangular panel having a first non-hypotenuse side, a second non-hypotenuse side and a hypotenuse side;

c. a third right triangular panel, said third right triangular panel having a first non-hypotenuse side, a second non-hypotenuse side, and a hypotenuse side;

d. said first right triangular panel being connected to said second right triangular panel along a fold line extending along the second non-hypotenuse side of said first right triangular panel and along the first non-hypotenuse side of said second right triangular panel, e. said third right triangular panel being connected to said second right triangular panel along a fold line extending along the first hypotenuse side of said third right triangular panel and along the second hypotenuse side of said second right triangular panel; and, f. cooperating interlocking means provided on said second non-hypotenuse side of said first right triangular panel and on said second non-hypotenuse side of said third right triangular panel; said interlocking means releasably mating in the plane of the first right triangular panel to secure the panels in position.

5. The blank of claim 4, wherein said cooperating interlocking means of said second non-hypotenuse side of said first right triangular panel is formed by a plurality of spaced tabs and said cooperating interlocking means of said second non-hypotenuse side of said third right triangular panel is formed by a plurality of spaced receiving cuts, wherein said spaced tabs and said spaced tab receiving cuts releasably mate in the plane of the first right triangular panel to secure the panels in position.

* * * * *